US006577216B2

(12) United States Patent
Turner et al.

(10) Patent No.: US 6,577,216 B2
(45) Date of Patent: Jun. 10, 2003

(54) FAST ACTING TRANSFER SWITCH WITH CONFRONTING POWER SWITCHES OPPOSITELY ACTUATED BY SINGLE COIL SOLENOID

(75) Inventors: David Curtis Turner, Imperial, PA (US); Jeffrey Lowell Woods, Pittsburgh, PA (US); David Michael Olszewski, McKees Rocks, PA (US); William Ellsworth Beatty, Jr., Brighton Township, PA (US)

(73) Assignee: Eaton Corporation, Cleveland, OH (US)

( * ) Notice: Subject to any disclaimer, the term of this patent is extended or adjusted under 35 U.S.C. 154(b) by 178 days.

(21) Appl. No.: 09/777,284

(22) Filed: Feb. 6, 2001

(65) Prior Publication Data

US 2002/0105397 A1 Aug. 8, 2002

(51) Int. Cl.[7] ..... H01H 9/00
(52) U.S. Cl. ..... 335/159; 335/160
(58) Field of Search ..... 335/2, 68–77, 335/159, 160, 161; 200/50.32–50.35

(56) References Cited

U.S. PATENT DOCUMENTS

| | | | | |
|---|---|---|---|---|
| 4,167,716 A | | 9/1979 | Horn | |
| 4,553,115 A | | 11/1985 | Grunert et al. | |
| 4,804,933 A | | 2/1989 | Becker et al. | |
| 4,926,041 A | * | 5/1990 | Boyd | 250/226 |
| 5,343,179 A | | 8/1994 | Pipich et al. | |

OTHER PUBLICATIONS

Cutler–Hammer, "*I.L. 29C200E*", Nov., 1998, pp. 1–9.

* cited by examiner

*Primary Examiner*—Elvin Enad
*Assistant Examiner*—Bernard Rojas
(74) *Attorney, Agent, or Firm*—Martin J. Moran

(57) ABSTRACT

An electrically powered, fast acting transfer switch utilizes two electric power switches mounted in spaced relation with the handles confronting and moveable in a common plane, but in opposite directions, so that when simultaneously operated by an electrically powered operator positioned between the two switches, one switch is ON and the other is OFF. A mechanical assembly converts the motion of a single acting solenoid into reciprocal operation of the switch handles.

6 Claims, 5 Drawing Sheets

FIG. 3
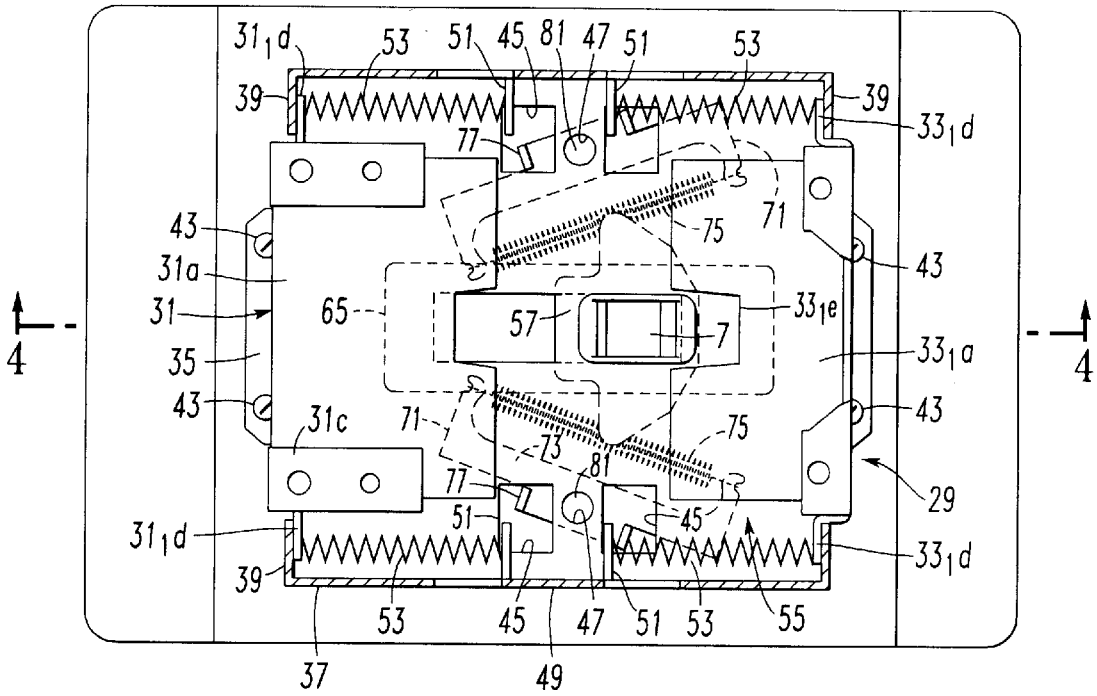
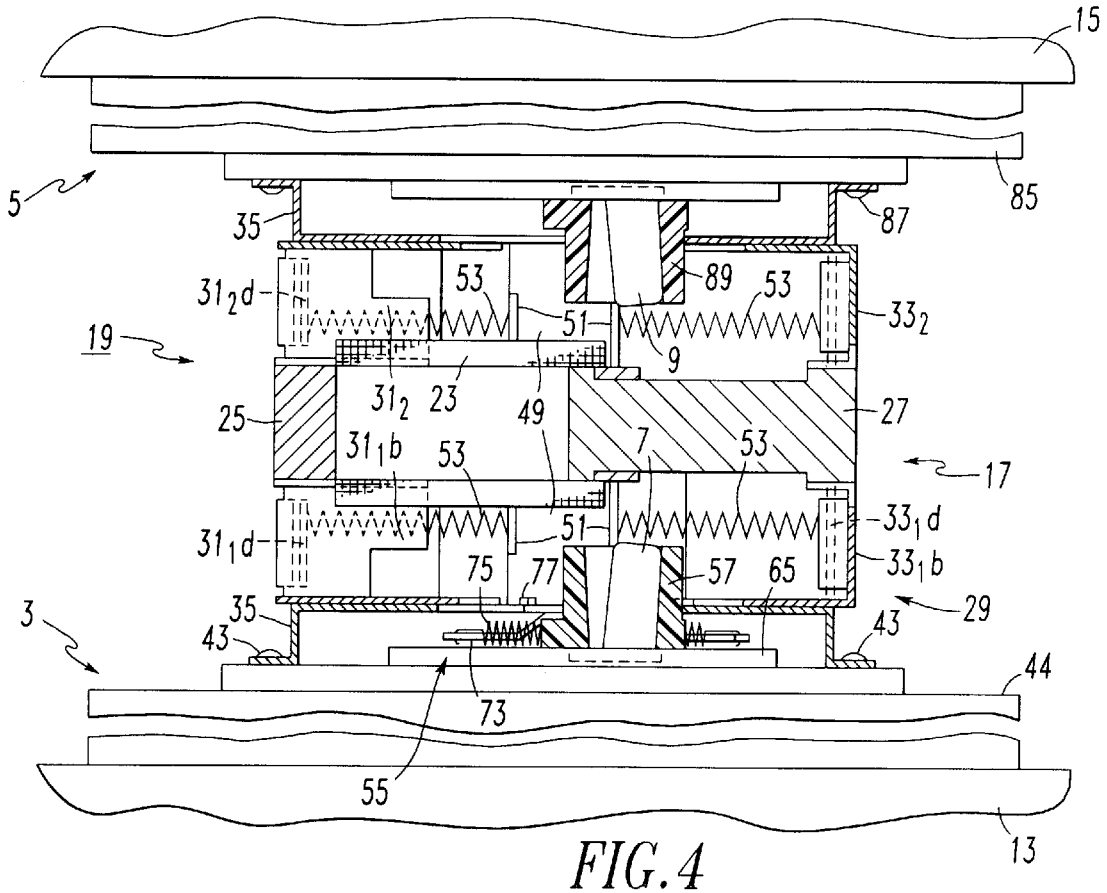
FIG. 4

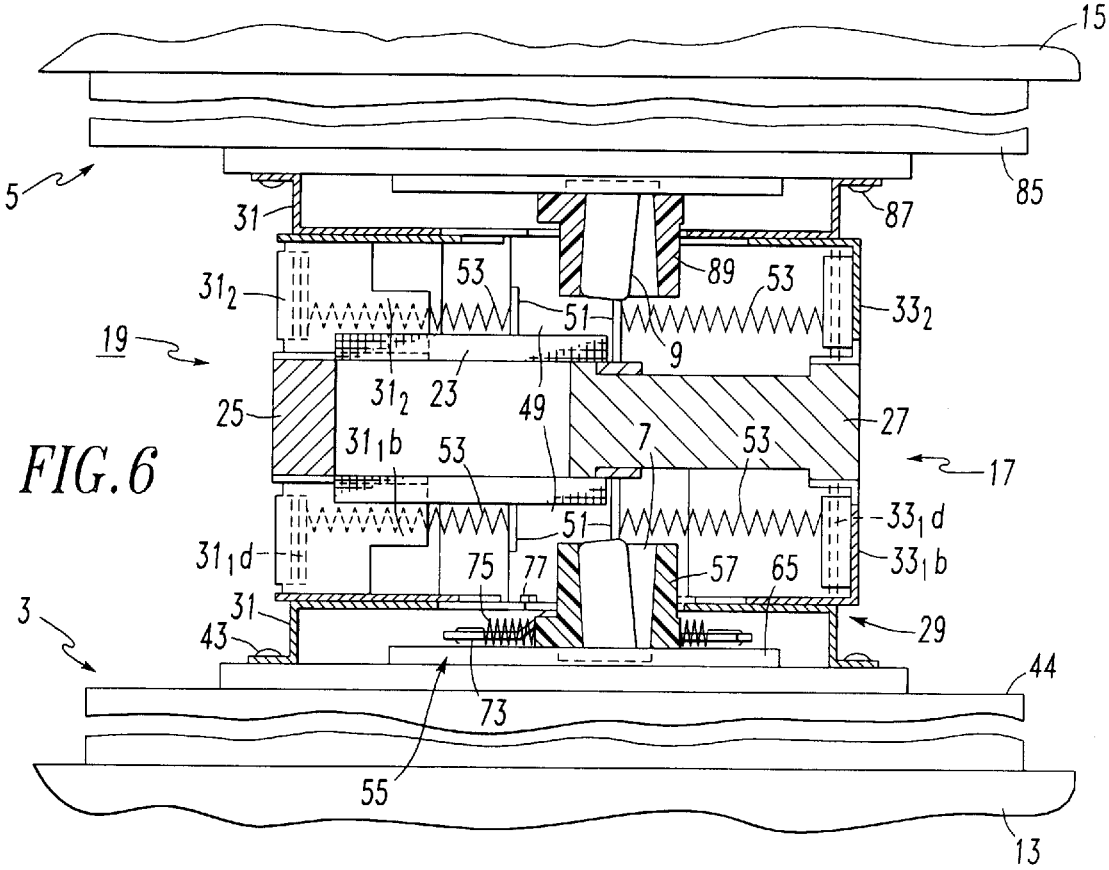
FIG. 6
FIG. 8
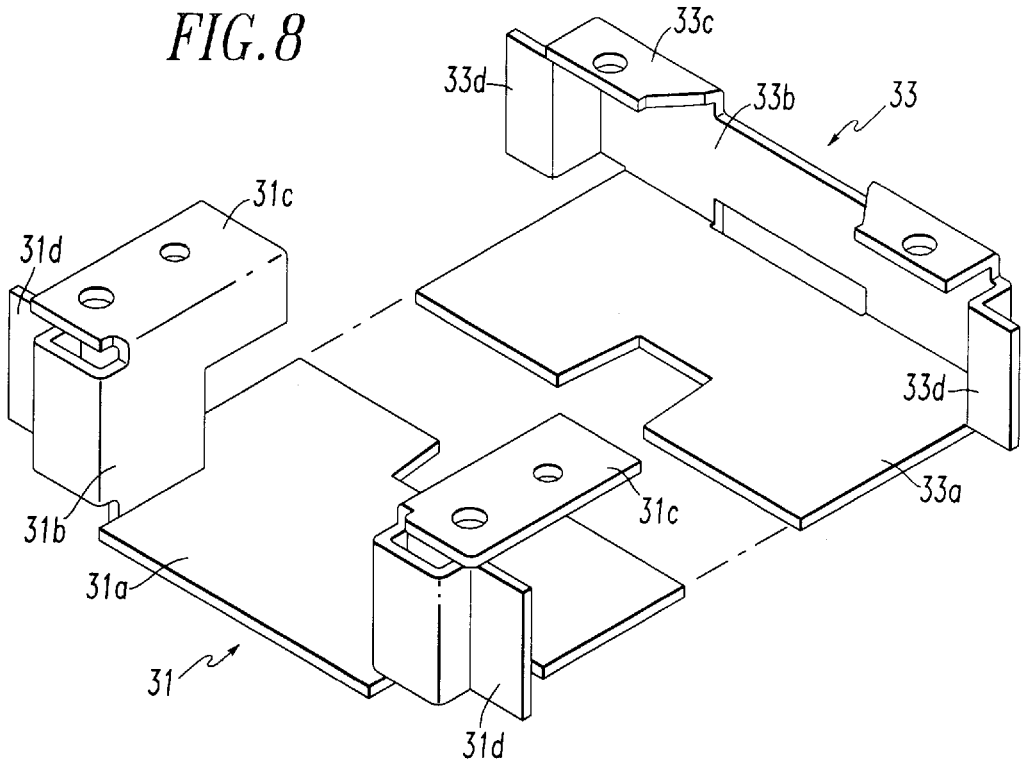

FAST ACTING TRANSFER SWITCH WITH CONFRONTING POWER SWITCHES OPPOSITELY ACTUATED BY SINGLE COIL SOLENOID

RELATED APPLICATION

Commonly owned, patent application Ser. No. 09/750,572, filed on Dec. 28, 2000, entitled "FAST ACTING, ELECTRICALLY POWERED OPERATOR FOR TRANSFER SWITCH AND TRANSFER SWITCH INCORPORATING SAME".

BACKGROUND OF THE INVENTION

1. Field of the Invention

This invention relates to switches for electric power distribution systems and, more particularly, to electrically powered operators for interlocking the operation of a pair of switches, such as those in a transfer switch.

2. Background Information

Transfer switches commonly used to connect alternate power sources to a load, including networks, utilize a pair of switches each connecting one of the sources to the load. In order to prevent connecting unsynchronized sources together, the operation of the two switches is coordinated, typically by a mechanical interlock, so that only one switch at a time can be turned ON. In many instances, it is desirable to operate the transfer switch remotely. Typically, electric motors have been used to operate the interlocks on transfer switches. The motor powered interlocks operate relatively slowly so that there is a noticeable dead period between the time that one of the switches is turned OFF and the other is turned ON. It is desirable to minimize this dead period while assuring that the two switches are never both ON at the same time.

U.S. Pat. No. 4,553,115 describes a solenoid powered operator for a single, molded case circuit breaker. This device operates the circuit breaker handle rapidly each time the solenoid is energized. It would be desirable to be able to operate the pair of switches in a transfer switch at a similar rapid rate, thereby reducing the interval in which the load is unenergized.

There is a need, therefore, for an improved operator for the switches of a transfer switch which allows the transfer to be made more rapidly.

SUMMARY OF THE INVENTION

This need, and others, are satisfied by the invention which is directed to a fast acting, electrically powered operator for first and second electric power switches mounted in spaced confronting relation with the handles facing each other and reciprocal together to oppositely switch the associated electric power switches on and off. The electrically powered operator comprises a solenoid and a mechanical assembly coupling the solenoid to the first handle and the second handle to reciprocate them to simultaneously turn one of the electric power switches on and the other off, and then to turn the one off and the other on, on successive actuations of the solenoid.

The solenoid is a single action solenoid having an electromagnet and an armature moveable relative to the electromagnet. The mechanical assembly comprises first and second electromagnet drive members secured to the electromagnet and extending toward the first handle and second handle, respectively. First and second armature drive members are secured to the armature and extend toward the first and second handle, respectively. The mechanical assembly also includes a latch mechanism reciprocal between a first latch position in which the first and second electromagnet drive members are held fixed and the first and second armature drive members move upon actuation of the single action solenoid, and a second latch position in which the first and second armature drive members are held fixed and the first and second electromagnet drive members move upon actuation of the single action solenoid. The first electric power switch is turned on and off on successive actuations of the single action solenoid by reciprocation of the first handle through alternate movement of the first handle by one and then the other of the first electromagnet drive member and the first armature drive member. The second electric power switch is turned on and off oppositely to the first electric power switch on successive actuations of the single action solenoid by reciprocation of the second handle through alternate movement of the second handle by one, and then the other, of the second electromagnet drive member and the second armature drive member. A handle yoke which also forms part of the mechanical assembly engages one of the handles and switches the latch mechanism between the first and second latch positions as that one handle reciprocates.

The invention also embraces a transfer switch incorporating first and second electric power switches with associated handles rectilinear reciprocal to turn the associated switch off and on, a mount mounting the first and second electric power switches in spaced relation with the handles confronting one another and the electrically powered operator as described.

BRIEF DESCRIPTION OF THE DRAWINGS

A full understanding of the invention can be gained from the following description of the preferred embodiments when read in conjunction with the accompanying drawings in which:

FIG. 3 is a horizontal section through the mechanical assembly shown in FIG. 2 taken along the line 3–3;

FIG. 4 is a vertical section through the transfer switch at the line 4–4 in FIG. 3;

FIG. 6 is a vertical section through the transfer switch at the line 6–6 in FIG. 5;

FIG. 8 is an isometric view of electromagnet and armature drive plates that form part of the mechanical assembly of the transfer switch.

DESCRIPTION OF THE PREFERRED EMBODIMENTS

Figure 1:
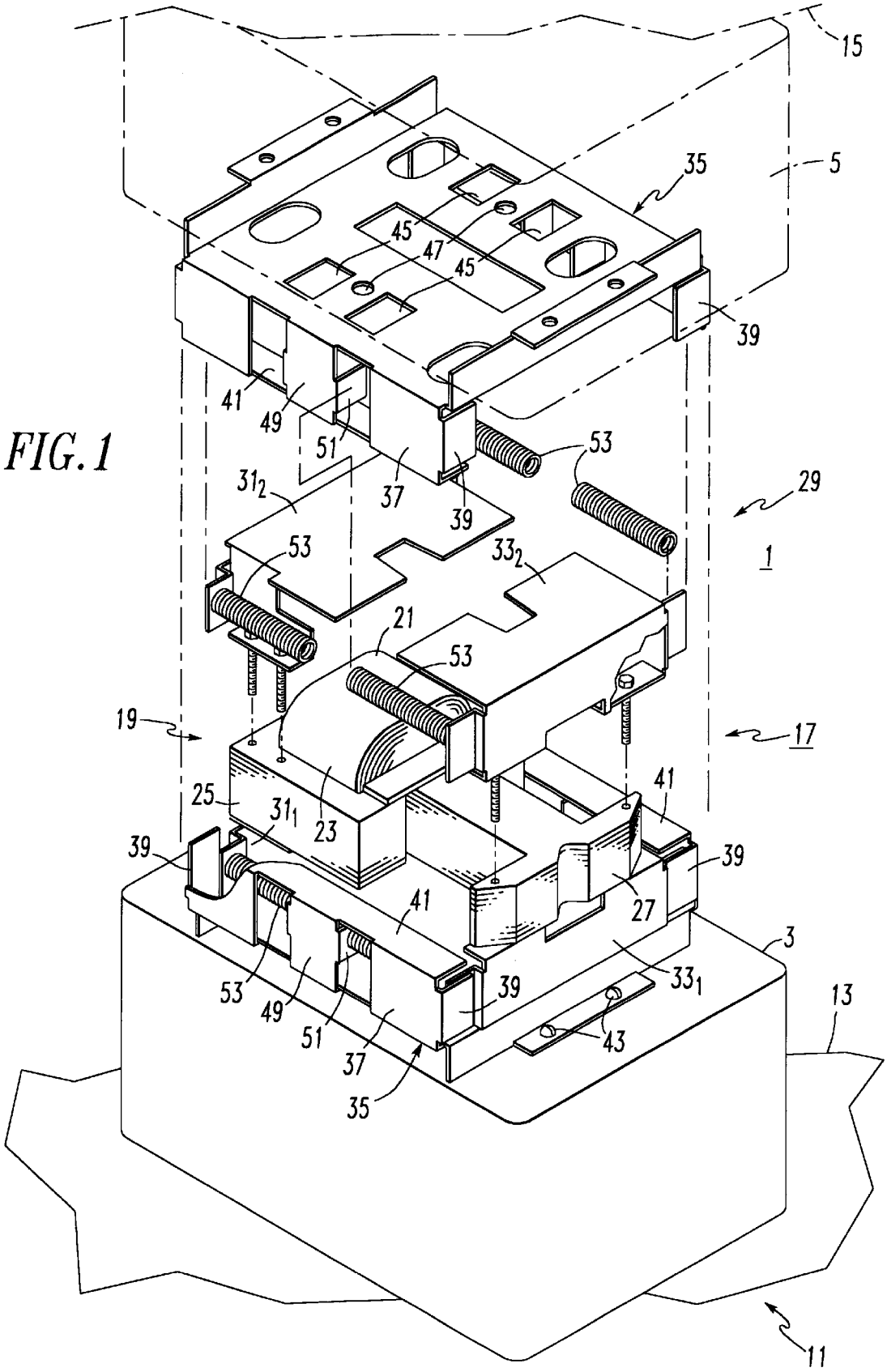
FIG. 1 is a partially exploded isometric view with a part cutaway of a transfer switch incorporating the invention.

FIG. 1 illustrates a transfer switch 1 which incorporates a pair of electric power switches 3 and 5. These electric power switches 3 and 5 can be molded case switches, which are well known in the power distribution field. If overcurrent protection is desired, the switches 3 and 5 can be circuit breakers. Referring also to FIG. 4, the switches 3 and 5 have handles 7 and 9, respectively, which move rectilinearly between ON and OFF positions, as is well known. A mount 11 in the form of a pair of spaced apart panels 13 and 15 support the two circuit breakers 3 and 5 in spaced relationship with the handles 7 and 9 confronting one another and moveable in a common plane. The switches 3 and 5 are oppositely oriented so that with the handles 7 and 9 turned in the same direction, one switch is ON and the other switch is OFF.

Simultaneous rectilinear movement of the handles 7 and 9 is effected by an electrically powered operator 17. The electrically powered operator 17 incorporates a single action solenoid 19 which includes an electromagnet 21 having a single electrical coil 23 wound on a magnetic core 25, and a generally T-shaped armature 27 that is moveable with respect to and within the electromagnet 21. The solenoid 19 is coupled to the handles 7 and 9 by a mechanical assembly 29. This mechanical assembly 29 includes first and second electromagnet drive members $\mathbf{31}_1$ and $\mathbf{31}_2$ secured to the electromagnet 21 and extending toward the handle 7 of the electric power switch 3 and the handle 9 of the electric power switch 5, respectively. The armature 27 is secured to first and second armature drive members $\mathbf{33}_1$ and $\mathbf{33}_2$ that also extend toward, but on the opposite sides of, the handles 7 and 9, respectively. The first electromagnet drive plate $\mathbf{31}_1$ and the first armature drive plate $\mathbf{33}_1$ slide rectilinearly in the same direction as the handle 7 on a mounting plate or frame 35, and are contained by side flanges 37, end flanges 39 and top flanges 41 formed by the mounting plate 35. The mounting plate or frame 35 is secured to the switch 3 by screws 43. In the same manner, the second electromagnet drive plate $\mathbf{31}_2$ and the second armature drive plate $\mathbf{33}_2$ slide rectilinearly in the same directions as the handle 9 on a similar mounting plate or frame 31 that is secured to the switch 5 by screws 43.

As the first and second electromagnet drive members $\mathbf{31}_1$ and $\mathbf{31}_2$ and the first and second armature drive members $\mathbf{33}_1$ and $\mathbf{33}_2$ are identical, they are illustrated in FIG. 8 by the common reference characters 31 and 33, respectively. As shown there, each electromagnet drive plate 31 has a flat base section 31*a*, upstanding side flanges 31*b* and horizontal terminal flanges 31*c* which are secured to the electromagnet 21. Offset end flanges 31*d* are aligned with the end flanges 39 on the mounting plate 35. The two armature drive plates 33, each have a flat section 33*a*, a vertical flange 33*b*, a horizontal terminal flange 33*c* which is secured to the armature 27, and offset end flanges 33*d* aligned with end flanges 39 on the respective mounting plates 35.

Figure 2:
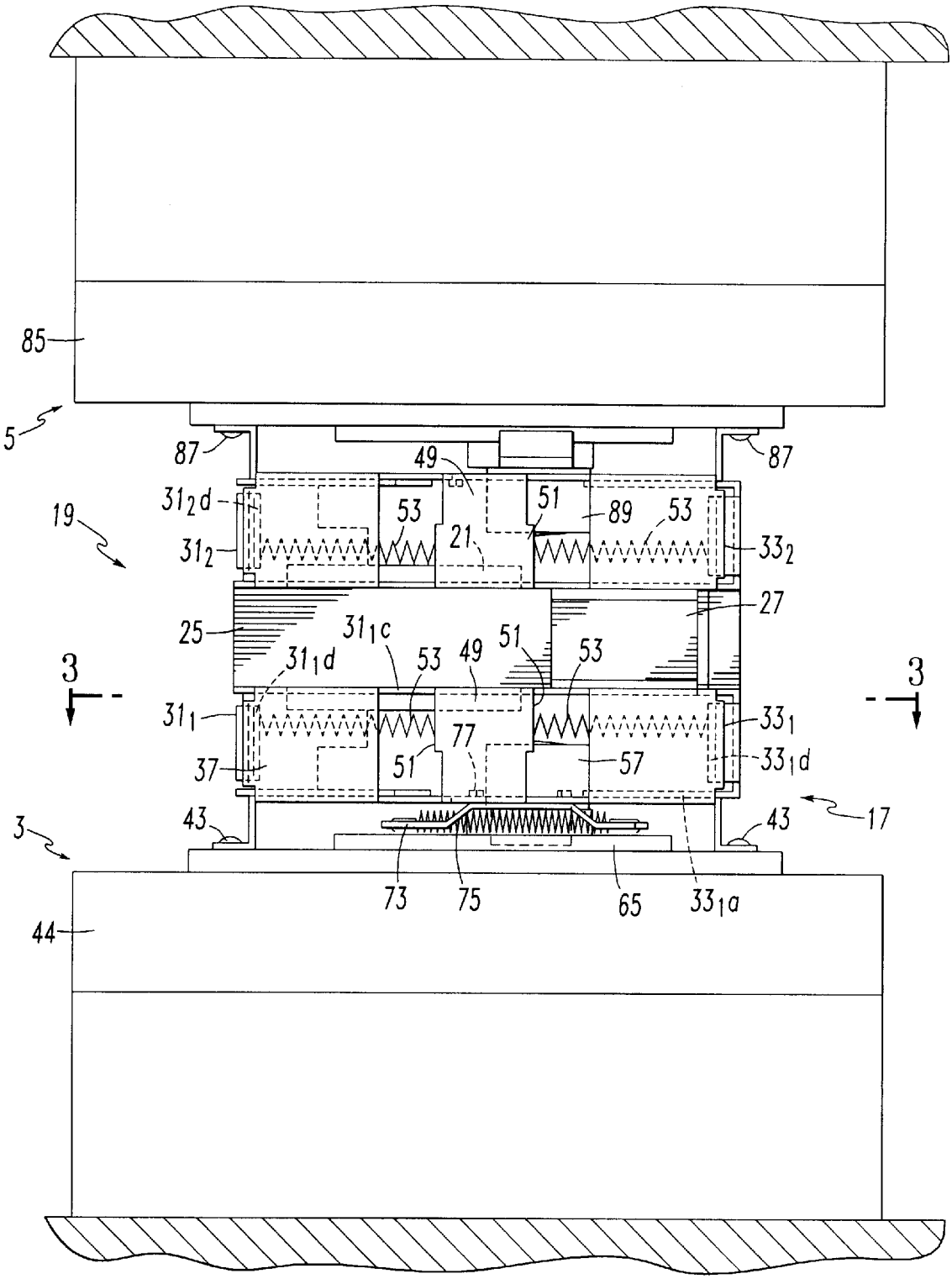
FIG. 2 is a side elevation view of the transfer switch of FIG. 1 showing the mechanical assembly with one switch in the OFF position and the other in the ON position;.

The mounting plate 35 secured to the switch 3 includes four rectangular latch slots 45 and a pair of latch pivot center apertures 47, as can be seen in FIG. 3. The mounting plate 35 also includes, at the center of each side, an integrally formed, upstanding spring bracket 49, each having a pair of integrally formed, inwardly bent rigid ears 51 for engaging the ends of four helical compression springs 53. These helical compression springs bear against offset end flanges $\mathbf{31}_1d$ of the electromagnet drive member $\mathbf{31}_1$ or the offset ends $\mathbf{33}_1d$ of the armature drive plate $\mathbf{33}_1$, as seen in FIGS. 2–4 to bias the drive members $\mathbf{31}_1$ and $\mathbf{33}_1$ to their limit positions.

Figure 7:
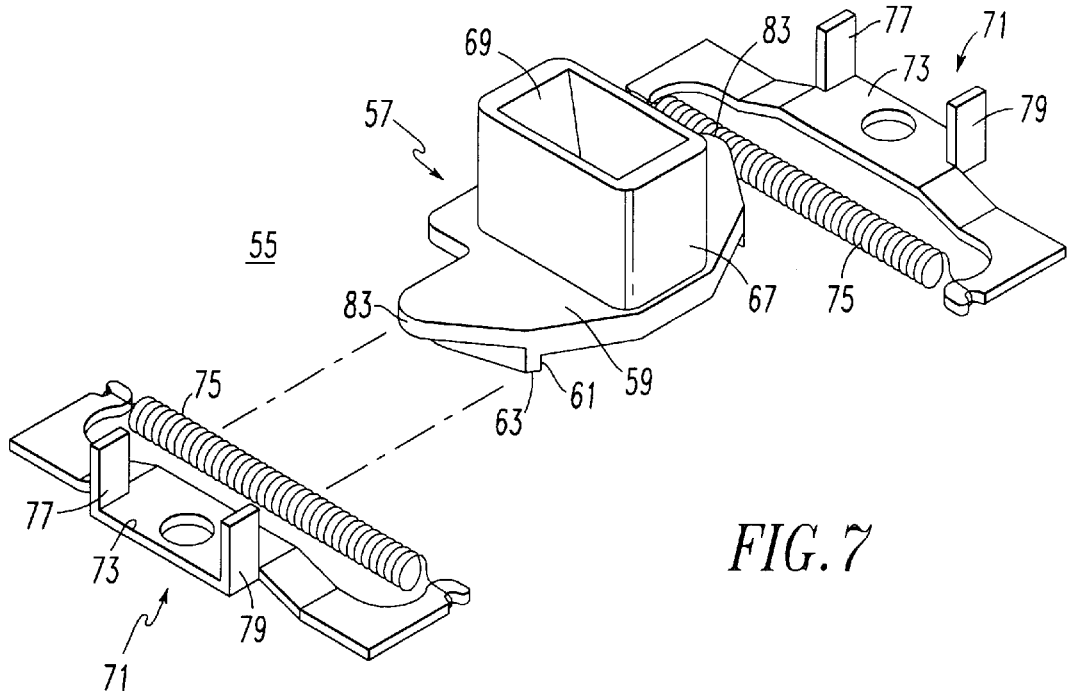
FIG. 7 is an isometric view of a latch mechanism which forms part of the mechanical assembly.

The mechanical assembly 29 incorporates a latch mechanism 55. As best seen in FIG. 7, this latch mechanism 55 includes a first yoke 57 which comprises a base 59 having a transverse slot 61 in a bottom face 63 that seats on and is guided for rectilinear movement by an escutcheon 65 on the molded housing 44 of the switch 3 surrounding the handle 7. The yoke 57 has an upstanding collar 67 with a through aperture 69 in which the handle 7 is captured. As will be seen the electromagnet drive plate 31, and the armature drive plate $\mathbf{33}_1$ bear against opposite sides of the yoke 57 to drive the handle 7 between the ON and OFF positions.

Latch mechanism 55 also includes a pair of pivotally mounted, bistable mechanical spring latches 71 configured to alternatively engage and stop further movement of the electromagnet drive member $\mathbf{31}_1$ and the armature drive member $\mathbf{33}_1$. Each of the spring latches 71 includes a pair of latch arms 73 and a helical tension spring 75 stretched between the ends of the latch arms 73. The latch arms 73 have stops 77 and 79 integrally formed on opposite ends that extend through the latch slots 45 in the mounting plate 35 and are configured to engage and stop the movement of the electromagnet drive member $\mathbf{31}_1$ and the armature drive member $\mathbf{33}_1$, respectively. The latch arms 73 are mounted for pivotally movement beneath the mounting plate 35 by pivot rivets 81 engaging the latch pivot apertures 47.

Figure 5:
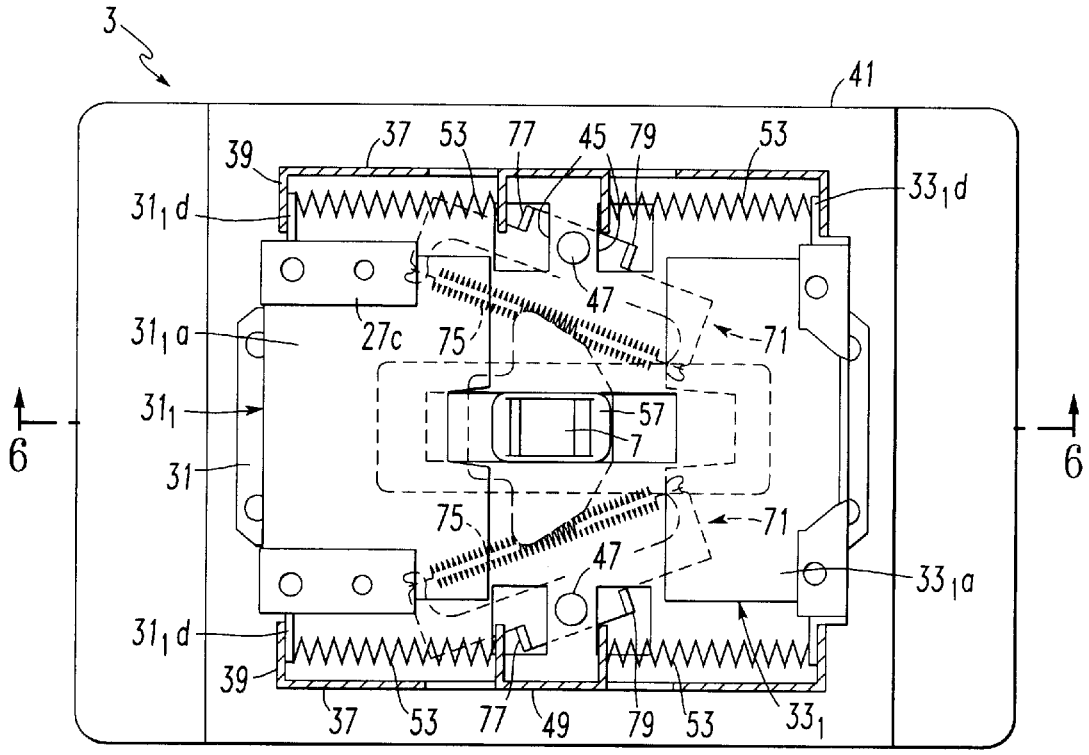
FIG. 5 is a horizontal sectional view similar to FIG. 3 but with the switch positions reversed.

The yoke 57 includes, at the laterally outward ends of the base 59, latch camming surfaces 83 which engage and laterally deflect the tension springs 75 on the latch arms 73. The latch arms 73 have two stable positions. In the first stable position, shown in FIG. 3, the latch arms 73 are rotated so that the stops 77 are in position to engage and limit the movement of the electromagnet drive member $\mathbf{31}_1$. In the second stable position, the latch arms 73 are rotated to the positions shown in FIG. 5, where the stops 79 are rotated inward to form stops for and set the limit of travel of the armature drive member $\mathbf{33}_1$. The bistable latch arms 73 rapidly transfer between the two stable positions by movement of the camming surfaces 83 on the base 59 of the yoke 57 from one side to the other of the pivot axis of the latch arms 73 as the yoke 57 is alternatively driven by the drive plates $\mathbf{31}_1$ and $\mathbf{33}_1$.

The second mounting plate 35 is secured to the molded housing 85 of the switch 5 by fasteners 87. This second mounting plate 35 also has spring brackets 49 each having a pair of integrally formed, inwardly bent rigid ears 51 for engaging the ends of four helical compression springs 53. These additional helical compression springs 53 bear against offset end flanges $\mathbf{31}_2d$ of the second electromagnet drive member $\mathbf{31}_2$ or the offset ends 33*d* of the second armature drive member $\mathbf{33}_2$, as seen in FIGS. 4 or 6, to bias these second drive members $\mathbf{31}_2$ and $\mathbf{33}_2$ to their limit positions. No latch mechanism 55 is needed for the second drive members $\mathbf{31}_2$ and $\mathbf{33}_2$, as they are rigidly connected to the first electromagnet drive member $\mathbf{31}_1$ and the first armature drive member $\mathbf{33}_1$ through the electromagnet 21 and the armature 27, respectively. However, the first and second electromagnet drive members, the first and second armature drive members and the mounting plates can be made identical to reduce part count.

The mechanical assembly 29 further includes a second yoke 89 which is seated on the second handle 9 and is driven reciprocally to move the switch 5 between the ON and OFF positions by the movement of the second electromagnet drive member $\mathbf{31}_2$ and the second armature drive member $\mathbf{33}_2$. Again, although the second yoke 89 does not have to engage a latch mechanism, it can be made identical to the first yoke 57 to reduce part count.

The operation of the transfer switch 1 is as follows:

Prior to the energization of the single action solenoid 19, the electromagnet drive members $\mathbf{31}_1$ and $\mathbf{31}_2$ and the first and second armature drive members $\mathbf{33}_1$ and $\mathbf{33}_2$ are biased by the helical compression springs 53 to their outer most limit positions against the end flanges 39 of the respective mounting plates 35. If the first handle 7 is in the OFF position, as shown in FIGS. 2–4, the armature drive member $\mathbf{33}_1$ is in engagement with the yoke 57 through slot $\mathbf{33}_1 e$ in the base $\mathbf{33}_1 a$. At the same time, the second handle 9 of the second switch 5 is in the ON position as, it will be recalled, the switches are oppositely oriented. Upon actuation of the single action solenoid 19, the first electromagnet drive member 33, is rapidly moved into engagement with the stops 77 which restrict further movement of the electromagnet drive plate $\mathbf{31}_1$ and therefore also of the second electromagnet drive member $\mathbf{31}_2$. However, as the armature 27 is rapidly pulled into the coil 23, the first armature drive member $\mathbf{33}_1$ slides along the mounting plate 35 resulting in the movement of the yoke 57 which, in turn, carries the handle 7 with it.

As the handle 7 passes through the toggle point of the switch 3, it rapidly travels to the ON position bringing the yoke 57 with it. When the camming surfaces 83 on the yoke 57 pass the pivots 81 on the latch arms, the latch arms 73 rapidly toggle to the position, shown in FIG. 5 and 6, wherein the stops 79 are in position to engage the first armature drive member $\mathbf{33}_1$. As the armature 27 moves, it carries with it the second armature drive member $\mathbf{33}_2$ which engages the second yoke 89 to operate the handle 9 of the second switch 5 from the ON position to the OFF position. The operating mechanism of the switches 3 and 5 are such that the switch 5 toggles OFF before the switch 3 is toggled ON so that there is a dead period in which both switches are OFF.

The next time the solenoid 19 is energized and the armature 27 is pulled into the coil 23, the first armature drive member $\mathbf{33}_1$ is restrained by the stops 79. Hence, the electromagnet, in effect, moves toward the armature, thereby pulling the first electromagnet drive member $\mathbf{31}_1$ with it. This electromagnet drive member $\mathbf{31}_1$ engages the yoke 57, thereby pushing the handle 7 back toward the OFF position. Simultaneously, the second electromagnet drive member $\mathbf{31}_2$ engages the second yoke 89 to move the handle 9 of the second switch 5 toward the ON position. Again, the switch 3 toggles OFF before the switch 5 is toggled ON to provide an open switching transition. As the camming surfaces 83 on the first yoke 57 pass the pivot rivets 81, the arms 53 toggle rapidly to rotate the stops 77 in position for engaging the first electromagnet drive member $\mathbf{31}_1$ the next time the solenoid 19 is energized.

The solenoid 19 provides rapid operation of the transfer switch 1. The mechanical assembly 26 allows a single action solenoid to be used, as the latch mechanism alternatively reverses the single motion of the solenoid for turning the switches OFF and ON.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A transfer switch comprising:

first and second electric power switches having associated first and second handles, respectively, rectilinearly reciprocal to turn the associated electric power switch off and on;

a mount mounting the first and second electric power switches in spaced relationship with the first and second handles confronting one another; and an electrically powered operator comprising:

a solenoid; and a mechanical assembly coupling the solenoid to the first handle and to the second handle to reciprocate the first handle and the second handle to simultaneously turn one of the first and second electric power switches ON and the other OFF, and then to turn the one of the first and second power switches OFF and the other ON, on successive actuations of the solenoid.

2. The transfer switch of claim 1 wherein the mount mounts the first and second electric power switches with the confronting first and second handles aligned but moveable in opposite directions to turn the associated electric power switch off and on.

3. The transfer switch of claim 2 wherein:

the solenoid comprises a single action solenoid having an electromagnet and an armature moveable relative to the electromagnet; and the mechanical assembly comprises:

first and second electromagnet drive members secured to the electromagnet and extending toward the first handle and second handle, respectively;

first and second armature drive members secured to the armature and extending toward the first and second handles, respectively; and a latch mechanism reciprocal between a first latch position in which the first and second electromagnet drive members are held fixed and the first and second armature drive members move upon actuation of the single action solenoid, and a second latch position in which the first and second armature drive members are held fixed and the first and second electromagnet drive members move upon actuation of the single coil solenoid, the first power switch being turned ON and OFF on successive actuations of the single action solenoid by reciprocation of the first handle through alternate movement of the first handle by one and then the other of the first electromagnet drive member and the first armature drive member, the second power switch being turned ON and OFF oppositely to the first power switch on successive actuations of the single action solenoid by reciprocation of the second handle through alternate movement of the second handle by one and then the other of the second electromagnet drive member and the second armature drive member; and a handle yoke engaging one of the first and second handles and switching the latch mechanism between the first and second latch positions as the one handle reciprocates.

4. An electrically powered operator for first and second electric power switches having associated first and second operating handles mounted by a mount in spaced confronting relation with the handles facing each other and reciprocal together to oppositely switch the associated electric power switches ON and OFF, the electrically powered operator comprising:

a solenoid; and a mechanical assembly coupling the solenoid to the first handle and to the second handle to reciprocate the first handle and the second handle to simultaneously turn one of the first and second electric power switches ON and the other OFF, and then to turn the one of the first and second power switches OFF and the other ON, on successive actuations of the solenoid.

5. The electrically powered operator of claim 4 wherein the mount mounts the first and second electric power switches with the confronting first and second handles aligned but moveable in opposite directions to turn the associated electric power switch OFF and ON.

6. The electrically powered operator of claim 5 wherein the solenoid comprises a single action solenoid having an electromagnet and an armature moveable relative to the electromagnet; and the mechanical assembly comprises:

first and second electromagnet drive members secured to the electromagnet and extending toward the first handle and second handle, respectively;

first and second armature drive members secured to the armature and extending toward the first and second handles, respectively; and a latch mechanism reciprocal between a first latch position in which the first and second electromagnet drive members are held fixed and the first and second armature drive members move upon actuation of the single action solenoid, and a second latch position in which the first and second armature drive members are held fixed and the first and second electromagnet drive members move upon actuation of the single action solenoid, the first electric power switch being turned ON and OFF on successive actuations of the single action solenoid by reciprocation of the first handle through alternate movement of the first handle by one and then the other of the first electromagnet drive member and the first armature drive member, the second electric power switch being turned ON and OFF oppositely to the first electric power switch on successive actuations of the single action solenoid by reciprocation of the second handle through alternate movement of the second handle by one and then the other of the second electromagnet drive member and the second armature drive member; and a handle yoke engaging one of the first and second handles and switching the latch mechanism between the first and second latch positions as the one handle reciprocates.

* * * * *